US005429199A

United States Patent [19]

Sheirer et al.

[11] Patent Number: 5,429,199

[45] Date of Patent: Jul. 4, 1995

[54] CUTTING BIT AND CUTTING INSERT

[75] Inventors: Daniel C. Sheirer, Bedford; Wayne H. Beach, Roaring Spring; Don C. Rowlett, Bedford, all of Pa.

[73] Assignee: Kennametal Inc., Latrobe, Pa.

[21] Appl. No.: 935,956

[22] Filed: Aug. 26, 1992

[51] Int. Cl.[6] ..... E21B 10/42; E21B 10/54

[52] U.S. Cl. ..... 175/321; 175/430; 175/431

[58] Field of Search ..... 175/430, 431, 426, 432, 175/321

[56] References Cited

U.S. PATENT DOCUMENTS

| | | | |
|---|---|---|---|
| 979,319 | 12/1910 | Ashton . | |
| 984,323 | 2/1911 | Vauclain . | |
| 2,578,593 | 12/1951 | Phipps . | |
| 2,614,814 | 10/1952 | Jones et al. . | |
| 2,650,071 | 8/1953 | Rassieur . | |
| 2,711,892 | 6/1955 | Fulke . | |
| 2,735,656 | 2/1956 | Höglund et al. . | |
| 2,740,611 | 4/1956 | Bowen . | |
| 2,756,967 | 7/1956 | Meutsch . | |
| 2,930,588 | 3/1960 | Lord . | |
| 3,131,779 | 5/1964 | Rowley et al. . | |
| 3,163,246 | 12/1964 | Vagins et al. . | |
| 4,098,362 | 7/1978 | Bonnice . | |
| 4,190,125 | 2/1980 | Emmerich et al. | 175/418 |
| 4,211,294 | 7/1980 | Multakh . | |
| 4,241,798 | 12/1980 | Jones . | |
| 4,303,136 | 12/1981 | Ball . | |
| 4,333,540 | 6/1982 | Daniels et al. . | |
| 4,352,400 | 10/1982 | Grappendorf et al. . | |
| 4,359,335 | 11/1982 | Garner . | |
| 4,373,593 | 2/1983 | Phaal et al. . | |
| 4,378,975 | 4/1983 | Tomlinson et al. . | |
| 4,440,247 | 4/1984 | Sartor . | |
| 4,478,297 | 10/1984 | Radtke . | |
| 4,498,549 | 2/1985 | Jurgens | 175/430 |
| 4,511,006 | 4/1985 | Grainger | 175/57 |
| 4,525,178 | 6/1985 | Hall . | |
| 4,527,931 | 7/1985 | Sarin . | |
| 4,529,048 | 7/1985 | Hall . | |
| 4,570,726 | 2/1986 | Hall . | |
| 4,602,691 | 7/1986 | Weaver . | |
| 4,604,106 | 8/1986 | Hall et al. . | |
| 4,627,503 | 12/1986 | Horton . | |
| 4,655,508 | 4/1987 | Tomlinson . | |
| 4,682,987 | 7/1987 | Brady et al. . | |
| 4,694,918 | 9/1987 | Hall | 175/329 |
| 4,702,649 | 10/1987 | Komanduri | 407/119 |
| 4,705,122 | 11/1987 | Wardley et al. | 175/430 |
| 4,751,972 | 6/1988 | Jones et al. . | |
| 4,776,241 | 10/1988 | Pollington . | |
| 4,811,801 | 3/1989 | Salesky et al. . | |

(List continued on next page.)

FOREIGN PATENT DOCUMENTS

| | | | |
|---|---|---|---|
| 202271 | 1/1956 | Australia . | |
| 103391 | 3/1984 | European Pat. Off. . | |
| 2205594 | 1/1973 | Germany . | |
| 840643 | 1/1984 | South Africa . | |
| 888557 | 11/1988 | South Africa . | |
| 2115460 | 9/1983 | United Kingdom . | |
| 2193740 | 2/1988 | United Kingdom . | |
| 395559 | 8/1973 | U.S.S.R. . | |
| 516813 | 9/1976 | U.S.S.R. . | |
| 621870 | 8/1978 | U.S.S.R. . | |
| 625036 | 8/1978 | U.S.S.R. . | |
| 646045 | 2/1979 | U.S.S.R. . | |
| WO92/14906 | 9/1992 | WIPO | 175/430 |

OTHER PUBLICATIONS

Pils, et al., "Preliminary Evaluation of the Relationship of Bit Wear to Cutting Distance, Forces, and Dust Using Selected Commercial and Experimental Coal- and Rock-Cutting Tools," U.S. Bureau of Mines, RI 9193 (1988).

(List continued on next page.)

*Primary Examiner*—Hoang C. Dang
*Attorney, Agent, or Firm*—John J. Prizzi

[57] ABSTRACT

A cutting bit useful for cutting various earth strata and the cutting insert, which may be made from a polycrystalline diamond composite, for such a cutting bit. The cutting bit has at least one pocket at the axially forward end thereof which receives its corresponding cutting insert. The cutting insert has at least one exposed cutting edge which is of an arcuate shape.

21 Claims, 4 Drawing Sheets

U.S. PATENT DOCUMENTS

| | | | |
|---|---|---|---|
| 4,819,748 | 4/1989 | Truscott . | |
| 4,836,178 | 6/1989 | Tomlinson | 125/39 |
| 4,858,707 | 8/1989 | Jones et al. . | |
| 4,861,350 | 8/1989 | Phaal et al. . | |
| 4,907,662 | 3/1990 | Deane et al. | 175/431 |
| 4,911,254 | 3/1990 | Keith . | |
| 4,913,244 | 4/1990 | Trujillo | 175/65 |
| 4,928,777 | 5/1990 | Shirley-Fisher . | |
| 4,932,484 | 6/1990 | Warren et al. . | |
| 4,989,578 | 2/1991 | Lebourg | 125/23.01 |
| 4,997,049 | 3/1991 | Tank et al. | 175/410 |
| 5,025,874 | 6/1991 | Barr et al. . | |
| 5,099,935 | 3/1992 | Anthon et al. | 175/415 |
| 5,106,391 | 4/1992 | Lloyd | 51/293 |
| 5,174,396 | 12/1992 | Taylor et al. | 175/420.1 |
| 5,180,022 | 1/1993 | Brady | 175/430 |
| 5,303,787 | 4/1994 | Brady | 175/430 |

OTHER PUBLICATIONS

Roepke et al., "Drag Bit Cutting Characteristics Using Sintering Diamond Inserts", U.S. Bureau of Mines, RI 8802 (1983).

Roepke et al., "Bit Ignition Potential with Worn Carbide Tips", U.S. Bureau of Mines, Technical Progress Report 121 (1983).

Fairhorst, "The Design of Rotary Drilling Bits" pp. 271–275.

Sitler, "Manufactured Diamond and Enhanced Mining Tool Performance", Society of Mining Engineers of AIME, Preprint No. 85–58 (1985).

Sitler, "Manufactured Diamonds and Enhanced Mining Tool Performance", Mining Engineering, Jan., 1987, pp. 41–43.

Ford, "Mine Roof Drill Bits That Save Money", Sandia Report SAND82–09476 (1982).

Ford et al., "Advanced Technology Roof Bolt Drill Bit Development Final Report" Sandia Report 82–2957 (1983).

Shafto et al., "Polycrystalline Diamond Compact Materials as Cutting Inserts for Rotary Drilling Tools in Boring".

Bureau of Mines Report, "Breakthrough in Roof-Bolt Drilling Technolgy".

Brady's Mining and Construction Supply Co. advertisement, "High Density Ceramic Roof Bits".

CUTTING BIT AND CUTTING INSERT

BACKGROUND OF THE INVENTION

The invention pertains to a cutting bit, including the cutting insert therefor, wherein the bit is useful for cutting through various earth strata. Specifically, the invention pertains to a roof drill bit for drilling bore holes in an underground mine.

The expansion of an underground mine, such as for example, a coal mine, requires digging a tunnel. Initially, this tunnel has an unsupported roof. Because the roof is not supported, there is an increased chance for a mine cave-in which, of course, adds to the dangers and safety hazards of underground coal mining. Furthermore, an unsupported roof is susceptible to rock and debris falling from the roof. This rock and debris can injure workers as well as creating hazardous clutter on the floor of the tunnel.

In order to support and stabilize the roof in an established area of an underground tunnel, bore holes are drilled in the roof. The apparatus used to drill these holes comprises a drill with a long shaft, i.e., drill steel, attached to the drill. A bit is detachably mounted to the drill steel at the distal end thereof. The bit is then pressed against the roof, and drilling apparatus operated so as to drill a bore hole in the roof. The bore holes extend between two feet to greater than twenty feet into the roof. At this point in the roof bolting operation, there is no overhead protection for the operator.

These bore holes are filled with resin and roof bolts are affixed within the bore holes. A roof support, such as roof panels is then attached to the roof bolts. The end result is a roof which is supported, and hence, is of much greater stability than the unsupported roof. This reduces the safety hazards associated with underground mineral mining. The roof bolting process is considered to be an essential underground mining activity.

Roof bolting accounts for the largest number of lost-time injuries in underground mining. During the roof bolting process, the roof is unsupported so that it does not have optimum stability. Furthermore, the roof bolting process exerts stresses on the roof so as to further increase the safety hazards during the roof bolting process. Thus, an increase in the speed at which the bore holes can be drilled contributes to the overall speed and efficiency of the roof bolting process.

The speed of drilling the bore holes is dependent upon the sharpness and useful life of the roof drill bit. A sharp roof drill bit results is faster penetration and drilling. A sharp roof drill bit also does not require as much force to be applied to drill the bore hole. A roof drill bit that is dull requires a great amount of force to be exerted on the drill bit which can lead to bending the drill steel. A roof drill bit that stays sharp provides for good speed and penetration in the drilling operation.

When a roof drill bit becomes dull, i.e., has worn past its useful life, the drill bit must be changed before further drilling can be undertaken. In order to change the roof drill bit, the drilling must be stopped, the drill steel and drill bit removed from the bore hole in process, the worn drill bit removed from the drill steel, and the new roof drill bit attached to the drill steel. This operation takes time away from the productive drilling process and decreases the overall efficiency of the roof bolting process.

The necessity to change the roof drill bit also keeps the operator down in the section of the mine that has an unsupported roof. The longer that the operator stays in the section of the mine with an unsupported roof, the greater the chances are that there will be injury due to the unsupported mine roof. The advantages of a longer drill bit life are very apparent.

Sometimes the roof drill bit may encounter a portion of the roof strata which will cause great stresses to be exerted on the roof drill bit as well as the connection between the drill bit and the drill steel. These stresses can cause the drill bit to fail or the connection between the drill bit and the drill steel to fail. Either one of these conditions is an undesirable consequence which can lead to reduced efficiency for the roof bolting process. The advantages of a strong drill bit and a connection between the drill bit and drill steel of good integrity are apparent.

In the past, cemented tungsten carbide has been the most popular material to use for the cutting insert in the roof drill bit. Cemented tungsten carbide has been recognized for many years as a hard material that is very suitable for application as a cutting insert in a roof drill bit. However, cemented tungsten carbide cutting inserts are typically capable of drilling only a limited number of bore holes, such as, for example, one or two four foot holes or even less (sometimes to a depth of only a few inches) depending on the earth (e.g. rock) strata being drilled, before it is necessary to use another cemented tungsten carbide cutting insert.

Typically, the cutting inserts are resharpened at a location remote from the location of the roof bolting process. Thus, in order to resharpen the cutting insert, the drill bit must be removed from the bore hole, the drill bit removed from the drill steel, and a new drill bit mounted to the drill steel. The cutting inserts can be resharpened so as to be able to drill again. It would be desirable to make a cutting insert that could be used more than once without the need to be resharpened.

Although cemented tungsten carbide has worked in a satisfactory fashion for many years, it would be desirable to make the cutting insert from a material that would retain its sharpness longer than cemented tungsten carbide. It would also be desirable to make the cutting insert from a material that would have a useful life longer than that of cemented tungsten carbide.

Heretofore, others have used polycrystalline diamond (PCD) compacts as cutting inserts in some applications. For example, U.S. Pat. No. 4,928,777 to Shirley-Fisher shows a polycrystalline cutting insert useful in a rotary drill bit such as used in the petroleum industry. U.S. Pat. No. 4,373,593 to Phaal et al. shows a polycrystalline diamond cutting insert for a rotary drill bit. Other patents which show the use of polycrystalline cutting inserts in rotary drill bits, which are typically used in the oil drilling industry, are U.S. Pat. Nos. 4,989,578 to Lebourg, 4,911,254 to Keith, 4,529,048 to Hall, 4,694,918 to Hall, and 4,811,801 to Salesky et al.

Heretofore, others have used a cutting insert which includes polycrystalline diamond as a cutting insert for a roof drill bit. U.S. Pat. No. 4,627,503 to Horton shows a roof drill bit that uses one laminate PCD cutting insert of a conventional shape.

The Brady's Mining and Construction Supply Co. of St. Louis, Miss. has introduced what they call a "high density ceramic" roof bit. The bit comprises an elongate shank integral with a pair of larger diameter lobes at the forward end thereof. A flat surface has been machined in these lobes whereby the flat surface receives a semi-circular cutting insert. The cutting insert is made from a PCD composite. The bit attaches to the end of a drill steel via a special adaptor and a plurality of roll pins. Although the Brady bit presents the use of a PCD composite as a cutting insert in a roof drill bit, there are a number of disadvantages incumbent with the Brady bit that would be highly desirable to overcome.

The Brady bit cutting insert is of a semi-circular shape. Because of the orientation of the cutting insert on the roof drill bit, much of the semi-circular cutting edge does not actually participate in the drilling. The presence of this portion of the PCD composite is unnecessary. Due to the relatively expensive nature of PCD composite cutting inserts, it would be highly desirable to provide a cutting bit useful for cutting earth strata, such as a roof drill bit, with a PCD composite cutting insert that does not have a wasted length of the cutting edge.

PCD composite cutting inserts are typically made from a circular blank. In the case of the Brady bit, the circular blank is cut in half to make two semi-circular cutting inserts. PCD composite blanks are relatively expensive. It would be highly desirable to provide a cutting bit useful for cutting earth strata, such as a roof drill bit, that has a PCD composite cutting insert of such a shape so as to make more efficient use of the circular PCD blank from which the cutting insert is made.

The Brady bit body has a sudden increase in diameter at the junction of the larger diameter lobes and the integral shank. Because of this sudden increase in diameter, there is the potential for the bit to fail under torsional forces at this juncture. It would be highly desirable to provide a cutting bit useful for cutting earth strata, such as a roof drill bit, that uses a PCD composite that does not have a propensity to failure under torsional forces, especially due to a difference in diameter along the length of the bit body.

A cutting insert made of PCD must not reach an elevated temperature, such as 1200° F. for over a certain duration, such as two minutes, or it will become brittle and its usefulness meaningfully reduced. The Brady bit body contains a water channel in the shank portion of the bit body. However, experience shows that water does not adequately reach the cutting insert because of turbulence caused by the water impinging upon the greater diameter lobes of the bit body. It would be highly desirable to provide a cutting bit useful for cutting earth strata, such as a roof drill bit, that provides a uniform and consistent water supply to the PCD composite cutting insert so that it will not fail due to temperature-related causes.

Because of the use of the special adapter and roll pins, the Brady bit requires a relatively long time to change bits in the field. It would be highly desirable to provide a roof drill bit that does not require a relatively long time to change bits in the field. The presence of a special adapter presents one more piece of structure to have the potential to fail in the field. It would be highly desirable to provide a cutting bit useful for cutting earth strata, such as a roof drill bit, that does not require a special adapter to attach the bit body to the drill steel.

The PCD composite cutting insert of the Brady bit lies in a flat machined out surface. The flat surface of the PCD composite cutting insert is brazed to the flat surface of the machined surface in the body. When the bit is placed under load in drilling, there is only one surface for the cutting insert to load against in the Brady bit. Such a circumstance can lead to shear stress failure of the PCD composite cutting insert, i.e., shear stresses catastrophically remove the cutting insert from the bit body. It would be highly desirable to provide a cutting bit useful for cutting earth strata, such as a roof drill bit, that is able to distribute the loading forces over more than one surfaces so as to reduce the potential for shear stress failure.

The semi-circular cutting insert of the Brady bit cannot be reused once it has passed its useful life. Because of the expense associated with PCD composite cutting inserts, it would be highly desirable to provide a cutting bit useful for cutting earth strata, such as a roof drill bit, that has a cutting insert which can be used more than once.

The orientation of the cutting inserts in the Brady bit are such that the cutting edges drill the entire transverse cross-section of the bore hole. It is known that drilling may proceed faster if the center of the bore hole is not in contact with the cutting inserts. This is the case for conventional two-prong bits that use cemented tungsten carbide cutting inserts. It would be desirable to provide a cutting bit useful for cutting earth strata, such as a roof drill bit, with a PCD composite cutting insert that does not drill across the entire transverse dimension of the bore hole.

SUMMARY OF THE INVENTION

It is a principal object of the invention to provide an improved cutting bit useful for cutting through various earth strata.

It is another principal object of the invention to provide an improved cutting insert for a cutting bit useful for cutting through various earth strata.

It is another object of the invention to provide an improved cutting bit useful for cutting through various earth strata that uses a PCD composite cutting insert.

It is an object of the invention to provide a cutting bit useful for cutting through various earth strata bit with a PCD composite cutting insert wherein the cutting insert does not have a wasted length of the cutting edge.

It is another object of the invention to provide a cutting bit useful for cutting through various earth strata with a PCD composite cutting insert wherein the cutting insert is of such a shape so as to make more efficient use of the circular PCD blank from which the cutting insert is made.

It is another object of the invention to provide a cutting bit useful for cutting through various earth strata that uses a PCD composite cutting insert that does not have a propensity to fail under torsional forces.

It is another object of the invention to provide a cutting bit useful for cutting through various earth strata with a PCD composite cutting insert that provides a uniform and consistent water supply to the PCD composite cutting insert so that it will not fail due to temperature-related causes.

It is another object of the invention to provide a cutting bit useful for cutting through various earth strata with a PCD composite cutting insert that does not require a special adapter to attach the bit body to the drill steel.

It is still a further object of the invention to provide a cutting bit useful for cutting through various earth strata with a PCD composite cutting insert that is able to distribute the loading forces on the cutting insert over more than one surface.

It is an additional object of the invention to provide a cutting bit useful for cutting through various earth strata with a PCD cutting insert that has a cutting insert which can be used more than once.

It is an object of the invention to provide a cutting bit useful for cutting through various earth strata with a PCD composite cutting insert that does not drill across the entire transverse dimension of the bore hole.

In one form thereof, the invention is a cutting bit which includes an elongate bit body with opposite axially forward and rearward ends. The bit body contains a pair of oppositely disposed pockets in the axially forward end thereof. The cutting bit further includes a pair of cutting inserts wherein each one of the cutting inserts has an arcuate cutting edge. The arcuate cutting edge is defined by an included angle of between about 90 degrees and about 120 degrees. Each one of the cutting inserts is affixed in its corresponding pocket so as to expose the cutting edge for cutting.

In another form thereof, the invention is a cutting bit which comprises a bit body with an axially forward end and an opposite axially rearward end. A pair of oppositely disposed diamond composite cutting inserts, wherein each of the cutting inserts has an arcuate cutting edge, are affixed to the axially forward end of the bit body in such a fashion so as to expose the cutting edge for cutting. The bit body contains at least one fluid port in the axially forward end thereof. The fluid port is adjacent to the cutting inserts so as to apply fluid to the cutting inserts during the cutting operation.

In another form hereof, the invention is a cutting insert for a cutting bit wherein the cutting insert comprises a pair of opposite front and rear surfaces and a pair of opposite edge surfaces. One of the edge surfaces is arcuate. The intersection of the front surface and the one edge surface defines an arcuate cutting edge.

In still another form thereof, the invention is a method of making a plurality of cutting inserts from a circular blank of a polycrystalline composite. The method steps comprise providing a circular blank of a polycrystalline diamond composite, and sectoring at least three cutting inserts from the blank.

BRIEF DESCRIPTION OF THE DRAWINGS

The following is a brief description of the drawings which form a part of this patent application.

Figure 1:
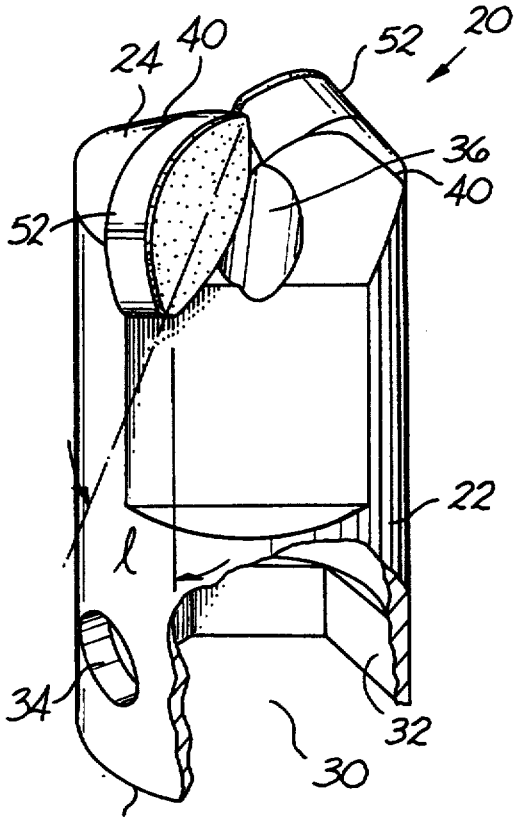
FIG. 1 is an isometric view of a first specific embodiment of the invention with a portion of the wall of the bit body cut-away to illustrate a portion of the internal surface of the bit body which has a hexagonal configuration.
Figure 1A:
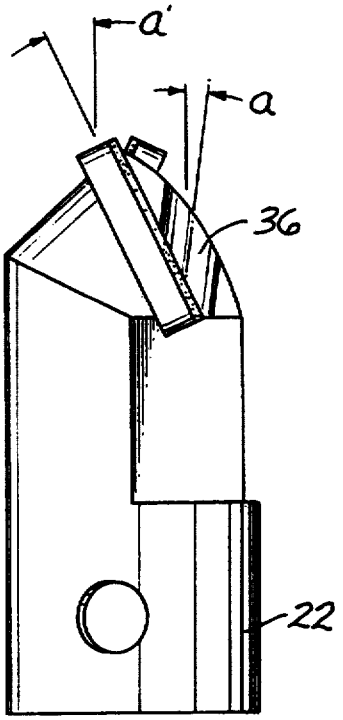
FIG. 1A is a side view of the specific embodiment of FIG. 1.

A detailed written description of the invention now follows.

DETAILED DESCRIPTION OF SPECIFIC EMBODIMENTS

Referring to the drawings, FIGS. 1, 1A, 2, 2A, 3, 3A, 3B, 4 and 4A illustrate all or part of a first specific embodiment of the roof drill bit invention, which is generally designated as 20. Roof drill bit 20 includes a drill bit body 22 having an axially forward end 24 and an opposite axially rearward end 26. The bit body 22 has a central bore 30 which opens at rearward end 26 and is closed at forward end 24. The interior surface of the bore 30 has a rearward portion 32 thereof, which is of a hexagonal configuration. The bit body 22 further includes a side aperture 34.

The bit body 22 contains at the axially forward end 24 thereof a pair of fluid ports 36 and 38. The central longitudinal axis of each fluid port is offset at an angle "a" of about 9.5° outwardly from the central longitudinal axis of the bit body. Thus, the included angle between the longitudinal axes of the fluid ports is about 19°. Fluid ports 36 and 38 are in communication with the central bore 30.

Figure 2:
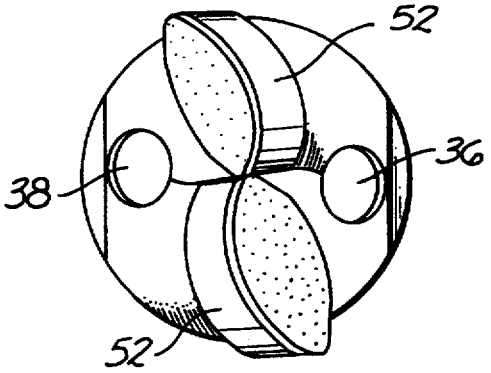
FIG. 2 is a top view of the specific embodiment of FIG. 1.
Figure 2A:
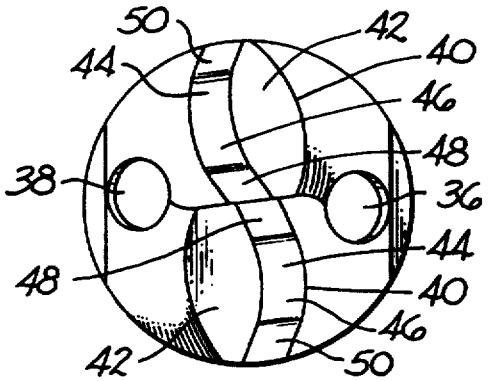
FIG. 2A is a top view of the bit body of the specific embodiment of FIG. 1 with the cutting inserts removed from the pockets to illustrate the pockets.

The bit body 22 contains a pair of oppositely disposed substantially identical separate pockets 40 in the axially forward end 24 thereof. Referring to FIG. 2A, each pocket 40 has a rear flat surface 42 which intersects with a bottom surface 44. The rear flat surface of each pocket is oriented so as to have a negative rake angle "a'" of 23°. This negative rake angle can be between 10° and 30°. The bottom surface 44 comprises an arcuate portion 46 with an upper flat portion 48 and a lower flat portion 50. This configuration of the bottom surface corresponds in shape to the corresponding surface of the cutting insert as will be discussed hereinafter.

Each pocket 40 receives its corresponding cutting insert 52. As shown in FIG. 1, each cutting insert 52 is disposed at a skew angle "1" from the vertical axis of about 48°. Thus, each cutting insert 52 is oriented at a negative rake angle "a'" and a skew angle "1".

The cutting inserts 52 are affixed in the pockets by brazing or the like. The preferred braze alloy is the EASY-FLO 45 braze alloy made by Handy & Harman, New York, N.Y. Physical properties of the braze alloy are set forth in product literature available from Handy & Harman. These properties include a solidus of 1125 ° F. (605 ° C.) and a liquidus of 1145 ° F. (620 ° C.). The nominal composition of this braze alloy is (in weight percent): 45 wt% Ag; 15 wt% Cu; 16 wt% Zn; 24 wt% Cd. This braze alloy is a low temperature alloy that brazes at a low enough temperature so as to not harm the polycrystalline diamond composite cutting insert.

Figure 3:
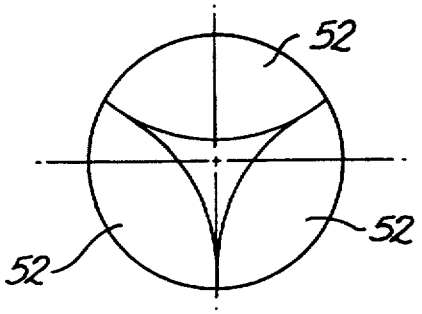
FIG. 3 is a schematic view which illustrates the manufacture of the cutting insert of the specific embodiment of FIG. 1 from a circular blank of PCD composite.

Cutting insert 52 comprises a polycrystalline diamond composite. In regard to the composition and microstructure of the cutting insert, the PCD composite is obtained from the Smith Diamond business unit of Sii Smith International, Inc., 275 West 2230 North, Provo, Utah 84604. Referring to FIG. 3B, a cross-sectional view shows a PCD layer 54 of a thickness "b" of about 0.025 inches, and a transition layer 56 of a thickness "c" of about 0.010 inches. The overall thickness "d" of the cutting insert is about 0.198 inches. Both layers are over a cemented tungsten carbide substrate 58.

The PCD layer is believed to be 100% polycrystalline diamond, The transition layer 56 is believed to be a mixture of 50 wt% polycrystalline diamond particles and 50 wt.% fine grained WC-Co. The cobalt content in the transition layer is between about 4–5 wt% Co. The substrate comprises bi-modal WC grains and Co. The WC grain size runs between 1 to 5 microns and 10 to 24 microns. The Co content in the substrate 58 is about 13 wt.%.

It is anticipated that other schemes of layers and compositions would be appropriate to use for this invention. U.S. Pat. No. 4,694,918 to Hall discloses some such schemes including a scheme using several layers having different contents of polycrystalline diamond. The '918 Hall Patent also discloses a high pressure sintering process that is thought to produce the specific polycrystalline diamond composite material of the invention.

It is contemplated that the cutting inserts could be made from cobalt cemented tungsten carbide (i.e. without diamond). The composition of some preferred grades of WC-Co are set out below:

| Grade | Co (wt %) | WC Grain Size (microns) | Hardness ($R_A$) |
|---|---|---|---|
| 1 | 5.4 | 1–18 | 88.2 |
| 2 | 6.3 | 1–12 | 89.6 |
| 3 | 6.0 | 1–9 | 90.7 |

It is also contemplated that a WC-Co composite comprising tungsten carbide of a submicron particle size with about 6 wt.% Co and about 0.5 wt.% Cr could be useful for the cutting insert. The braze alloy typically used for WC-Co inserts is HIGH TEMP 080 manufactured and sold by Handy & Harman, Inc., 859 Third Avenue, New York, N.Y. 10022. The nominal composition (weight percent) and the physical properties of the Handy & Harman HIGH TEMP 080 braze alloy (according to the pertinent product literature from Handy & Harman, U.S. Pat. No. 4,631,171 covers the HIGH TEMP 080 braze alloy) are set forth below:

| | | | |
|---|---|---|---|
| NOMINAL COMPOSITION | Copper | 54.85% | ±1.0 |
| | Zinc | 25.0 | ±2.0 |
| | Nickel | 8.0 | ±0.5 |

-continued

| | | | |
|---|---|---|---|
| | Manganese | 12.0 | ±0.5 |
| | Silicon | 0.15 | ±0.5 |
| | Other Elements | 0.15 | |
| PHYSICAL PROPERTIES: | Color | Light Yellow | |
| | Solidus | 1575° F. (855° C.) | |
| | Liquidus (Flow Point) | 1675° F. (915° C.) | |
| | Specific Gravity | 8.03 | |
| | Density (lbs/cu.in.) | .290 | |
| | Electrical Conductivity (% I.A.C.S.) | 6.0 | |
| | Electrical Resistivity (Microhm-cm.) | 28.6 | |
| | Recommend Brazing Temperature Range | 1675–1875° F. (915–1025° C.) | |

Another braze alloy which applicants consider to be acceptable is the HANDY HI-TEMP 548 braze alloy. HANDY HI-TEMP 548 alloy is composed of 55±1.0 w/o (weight percent) Cu, 6±0.5 w/o Ni, 4±0.5 w/o Mn, 0.15±0.05 w/o Si, with the balance zinc and 0.50 w/o maximum total impurities. Further, information on HANDY HI-TEMP 548 can be found in Handy & Harmon Technical Data Sheet No. D-74 available from Handy & Harmon, Inc.

Figure 3A:
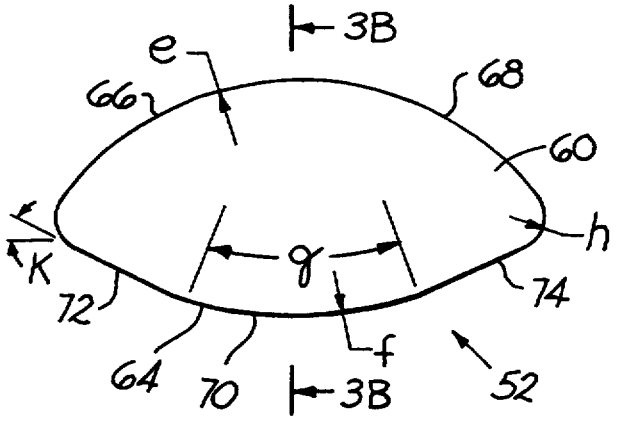
FIG. 3A is a front view of the cutting insert from the specific embodiment of FIG. 1.
Figure 3B:
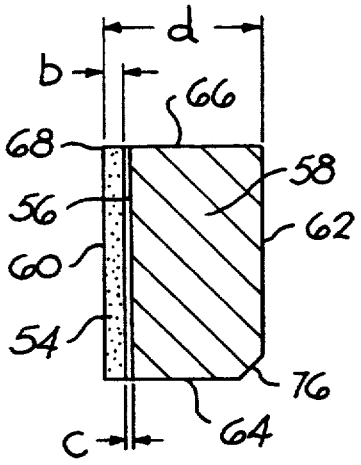
FIG. 3B is a cross-sectional view of the cutting insert of FIG. 3A.
Figure 4:
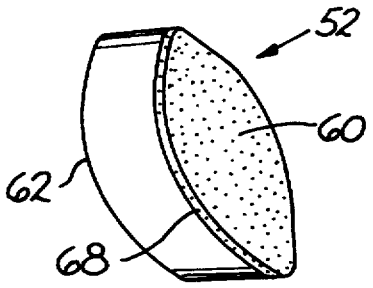
FIG. 4 is an isometric view of the cutting insert of the specific embodiment of FIG. 1.
Figure 4A:
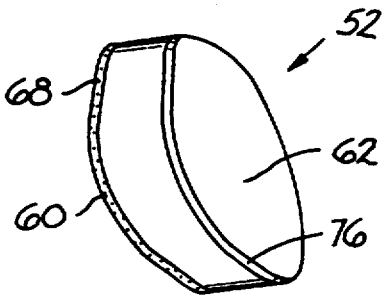
FIG. 4A is an isometric view of the cutting insert of FIG. 4 rotated 180° about its longitudinal axis.

In regard to the geometry of the cutting insert 52, referring to FIGS. 3A and 3B, the cutting insert 52 has a front flat surface 60, a rear flat surface 62, a bottom surface 64 which has a generally arcuate configuration and a separate top arcuate surface 66. The front flat surface intersects with the top arcuate surface 66 to define an arcuate cutting edge 68.

The actual finished cutting insert 52 has a top arcuate surface 66 formed by a 0.380 inch radius "e" which spans an arc of slightly less than 120°. The bottom surface has a central arcuate portion 70 defined by a radius "f" of 0.500 inches that spans an arc "j" of 60°. A flat portion (72, 74) joins each opposite end of the central arcuate portion 70. Each flat portion 72, 74 is disposed at angle "k" of 30° from horizontal as shown in FIG. 3A. The configuration of the bottom surface 64 generally corresponds to the configuration of the bottom surface 44 of pocket 40. The ends of the cutting insert are rounded by a 0.040 inch radius "h". There is a chamfer 76 at the substrate edge diagonally opposite from the cutting edge 68.

Referring to FIG. 3, this schematic view illustrates how three cutting inserts may be cut from the circular blank of a PCD composite. Electric discharge machining is the typical procedure used to cut these inserts from a blank.

Figure 5:
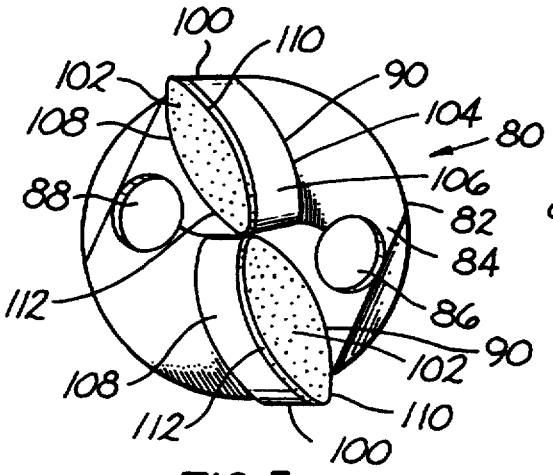
FIG. 5 is a top view of a second specific embodiment of the invention wherein the cutting inserts are reversible.
Figure 5A:
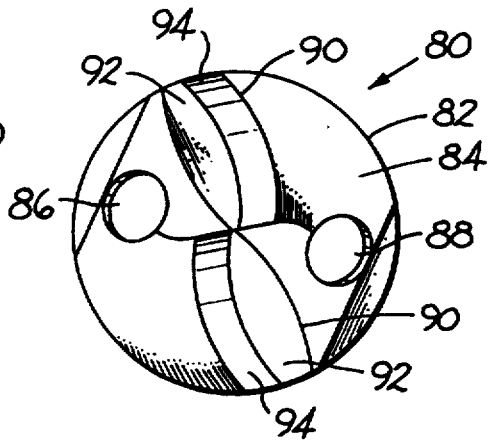
FIG. 5A is a top view of embodiment of FIG. 5 with the cutting inserts removed to illustrate the pockets.

Referring to FIG. 5 and FIG. 5A, this drawing illustrates a second specific embodiment of the invention, which is generally designated as 80. The structure of the second embodiment is similar to that of the first specific embodiment, except with respect to the cutting inserts and the pockets that hold the cutting inserts. In the first specific embodiment, the cutting inserts are not reversible. In other words, the cutting insert 52 of the first specific embodiment 20 cannot be turned and be held in the pocket. In the second specific embodiment 80, the cutting inserts are reversible. In other words, the cutting insert can be reversed (or inverted) so that either the top cutting edge or the separate bottom cutting edge may be exposed for cutting as will be described hereinafter.

A description of the second embodiment now follows. Roof drill bit 80 includes a drill bit body 82 having an axially forward end 84 and an opposite axially rearward end. The bit body 82 has a central bore which opens at the rearward end and is closed at the forward end 84. The bit body 82 contains in the axially forward end 84 thereof a pair of fluid ports 86 and 88. Fluid ports 86 and 88 are in communication with the central bore.

The bit body 82 contains a pair of oppositely disposed pockets 90 in the axially forward end 84 thereof. Each pocket 90 has a rear flat surface 92 which intersects with an arcuate bottom surface 94.

Each pocket 90 receives its corresponding cutting insert 100. Cutting insert 100 comprises a polycrystalline composite which has a composition and microstructure like that of cutting insert 52. Thus, the earlier description will not be repeated herein.

In regard to the geometry of the cutting insert 100, the cutting insert 100 has a front flat surface 102, a rear flat surface 104, a top arcuate surface 106 and a bottom arcuate surface 108. The polycrystalline diamond layer is on the front face 102 of the insert 100. The front flat surface 102 intersects with the top arcuate surface 106 to define a first (or top) cutting edge 110. The front flat surface 102 intersects with the bottom arcuate surface 108 to define a second (or bottom) cutting edge 112. One should note that in FIG. 5, the upper cutting insert 100 as viewed in FIG. 5 is in a position to present the top cutting edge 110 ready for drilling, and the lower cutting insert 100 is in a position to present the bottom cutting edge 112 ready for drilling. Although not illustrated, each substrate edge that is diagonally opposite to the cutting edges 110 and 112 has a chamfer thereat. The purpose of the chamfer is to facilitate the proper seating of the cutting insert in the pocket.

Figure 6:
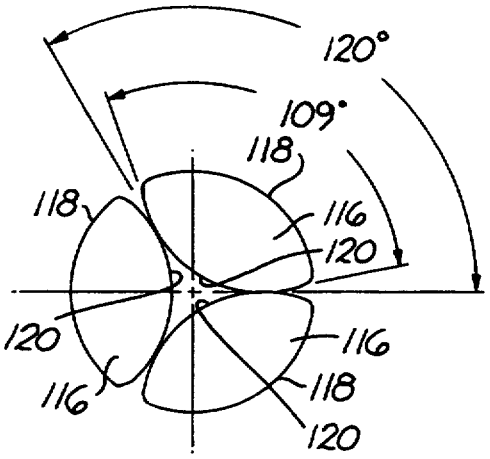
FIG. 6 is a schematic view illustrating the manufacture of three reversible cutting inserts from a circular blank of a PCD composite.
Figure 7:
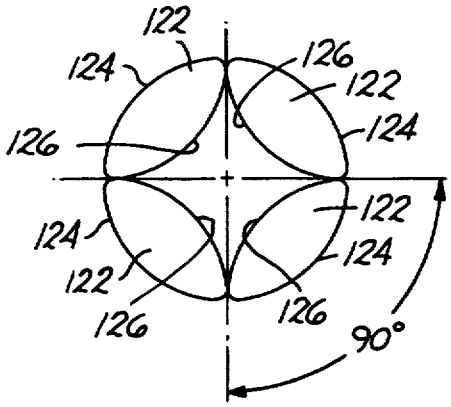
FIG. 7 is a schematic view illustrating the manufacture of four reversible cutting inserts from a circular blank of a PCD composite.

Referring to FIGS. 6 and 7, these schematic drawings illustrate how circular blanks of polycrystalline diamond composite material can be sectioned to produce three cutting inserts (FIG. 6) or four cutting inserts (FIG. 7). In regard to FIG. 6, three identical cutting inserts 116, each having opposite cutting edges 118, 120 that span an arc of about 109°, can be cut from the circular blank. In regard to FIG. 7, four identical cutting inserts 122, each having opposite identical cutting edges 124, 126 that span an arc of about 90° can be sectioned from the circular blank. The inserts are typically cut from the blanks by electric discharge machining techniques.

Figure 8:
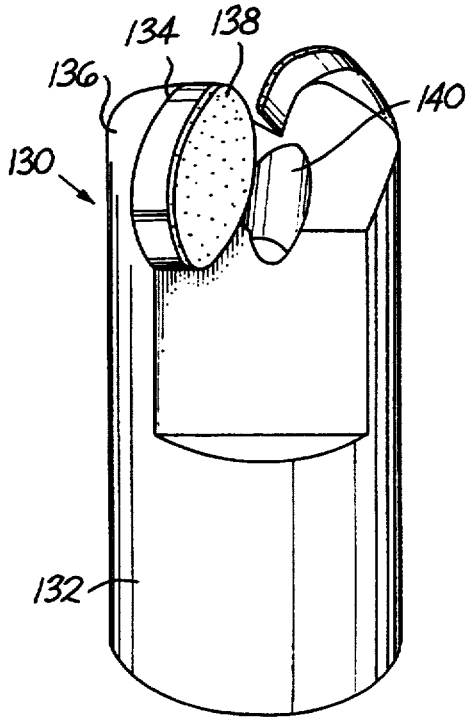
FIG. 8 is an isometric view of a third specific embodiment of the invention wherein the cutting inserts are spaced apart along a diameter of bit body.
Figure 9:
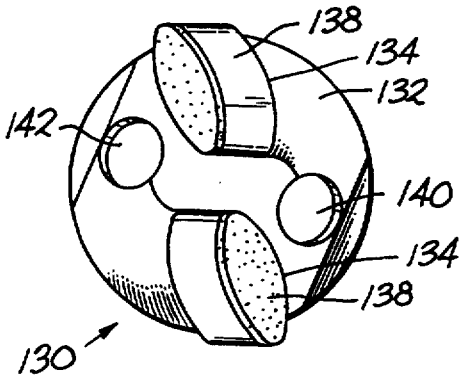
FIG. 9 is a top view of the specific embodiment of FIG. 8.

Referring to FIGS. 8 and 9, a third specific embodiment of the roof drilling bit of the invention is illustrated therein, and is generally designated as 130. The third specific embodiment of the roof drilling bit 130 is of the same general structure as the second specific embodiment, except that the pockets which hold the cutting inserts are spaced apart along the diameter of the bit body, and thus, are not as long as the pockets in the second specific embodiment. In this regard, the bit body 132 of the roof drilling bit 130 has a pair of pockets 134 contained in the axially forward end thereof 136. Each pocket 134 receives a cutting insert 138 which is of the same general configuration as cutting insert 100. The bit body 132 contains fluid ports 140 and 142 in the axially forward end thereof.

Because the cutting inserts are spaced apart, the cutting edges do not contact the bore hole across the entire transverse dimension thereof. As will be discussed hereinafter, this permits the roof drill bit to drill faster since less of the strata is actually being drilled to make the bore hole.

Figure 10:
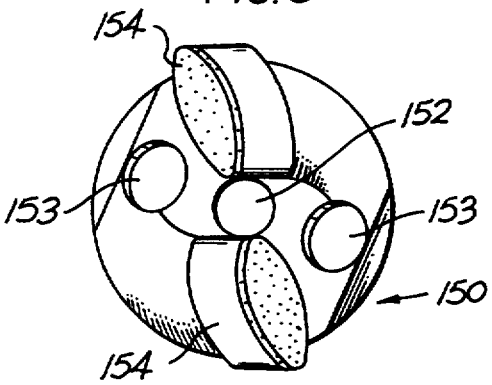
FIG. 10 is a top view of a fourth specific embodiment of the invention.

Referring to FIG. 10, a fourth specific embodiment of the roof drilling bit of the invention, generally designated as 150, is shown therein. The fourth specific embodiment of the roof drilling bit has the same general structure as the third specific embodiment, except that there is a third central fluid port 152, along with fluid ports 153, between the cutting inserts 154. The presence of the third fluid port 152 further facilitates the application of coolant, i.e., water, to the polycrystalline diamond composite cutting inserts 154.

The operation of the four specific embodiments of the invention is essentially the same. For all embodiments, the bit is detachably mounted to the distal end of a hollow drill steel rod (not illustrated) of a bore hole drilling apparatus. The hexagonal interior portion of the bit body bore registers with the hexagonal shape of the drill steel. A button clip (Kennametal Model 9200 clip) or the like secures the roof drill bit to the drill steel. The drill bit is pressed against the roof of the tunnel, rotated, and the roof strata is drilled to form a bore hole.

As previously mentioned, it is important that the polycrystalline diamond composite cutting insert be kept at a temperature low enough to preclude failure due to temperature-related causes. In order to keep the cutting inserts sufficiently cool, water impinges upon the cutting inserts.

Water is supplied under pressure into the central bore of the bit body via the hollow drill rod, and because of the communication between the fluid ports and the central bore, the water exits the fluid ports onto the cutting inserts to keep the cutting inserts below an unacceptably high temperature. For the first, second and third specific embodiments, the water exits the two fluid ports and impinges on the cutting inserts. For the fourth specific embodiment, water exits these fluid ports and impinges on the cutting inserts.

For the second, third and fourth specific embodiments, the pocket which receives the cutting insert is basically the same; namely, the pocket is of an arcuate shape. Consequently, when the roof drill bit encounters portions of the strata which exert shear stresses on the cutting insert, the arcuate shape of the pocket helps support the cutting insert against shear forces which try to separate the cutting insert from the pocket in the bit body. The shape of the pocket of the first specific embodiment is generally arcuate. More specifically, the central portion is arcuate and a flat portion is at each opposite end of the arcuate portion. This configuration also provides support for the cutting insert against shear forces.

For all of the specific embodiments, the roof drill bit is easy to change since it attaches to a standard drill steel in a conventional fashion without the need of special adapters or the like.

Figure 11:
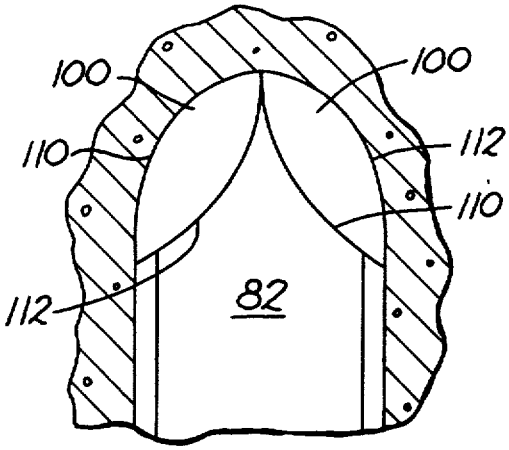
FIG. 11 is a mechanical schematic view showing the cutting by the roof drilling bit of the second specific embodiment of the present invention.
Figure 12:
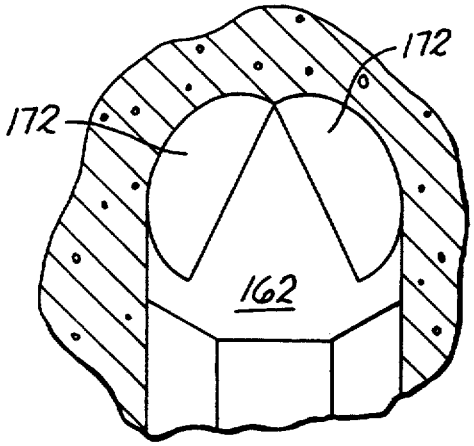
PRIOR ART FIG. 12
FIG. 12 is a mechanical schematic view showing the cutting by a prior art Brady bit.

Referring to FIG. 11, which is a schematic view that shows the relationship of the cutting one sees that the cutting inserts of the specific embodiments of the present invention are oriented so that there is virtually none of the cutting edge that does not participate directly in the cutting of the bore hole. Because of the orientation of the cutting inserts, virtually all of the cutting edge contacts the strata to drill the bore hole. This is contrast to the non-use of a significant portion of the semi-circular cutting edge of the earlier Brady bit as shown by FIG. 12. The Brady bit is illustrated in FIG. 13 hereof and is discussed hereinafter.

Figure 13:
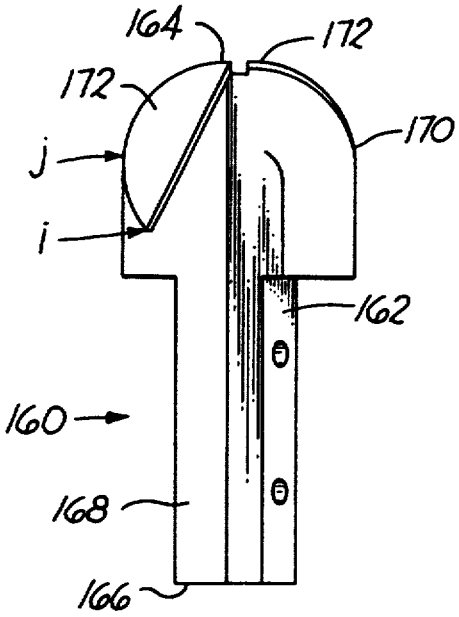
PRIOR ART FIG. 13
FIG. 13 is an isometric view of the prior art Brady bit.

Referring to FIG. 13, this drawing shows the Brady bit, generally designated 160, which is prior art to the present invention. This bit has an elongate steel body 162 with opposite forward 164 and rearward ends 166.

The body has a reduced diameter shank 168 and an enlarged diameter lobe portion 170. The lobe portion 170 presents oppositely facing flat surfaces that receive semi-circular cutting inserts 172. The cutting inserts are oriented on the lobe 170 portion so that a length of the cutting edge, as measured from point i to point j, does not directly participate in the cutting.

The second, third and fourth specific embodiments use what has been termed as reversible cutting inserts. These cutting inserts present two opposite arcuate cutting edges which are substantially the same. Thus, once a roof drill bit approaches the end of its useful life, the cutting insert can be unbrazed from the pocket, inverted to expose the unused cutting edge, and rebrazed into the pocket.

This concept of cutting insert invertibility has application to cemented tungsten carbide cutting inserts and PCD composite cutting inserts. For the cemented carbide cutting inserts, the invertibility of the cutting insert allows the cutting insert to be used a second time prior to any regrinding. For the PCD composite cutting insert, the invertibility essentially doubles the useful life of a cutting insert that is made from expensive material.

The third and fourth specific embodiments of the invention present roof drill bits in which the cutting inserts are spaced apart along a transverse diameter of the bit body. In the drilling operation, the center core of the bore is not actually drilled out by the roof drill bit. However, the center core is sufficiently unstable so that it breaks off during the drilling operation. The drilling operation is able to proceed faster because the roof drill bit does not drill across the entire diameter of the bore hole as opposed to a drilling operation where the roof drill bit drills across the entire face of the bore hole.

What is claimed is:

1. A rotatable cutting bit comprising:

an elongate bit body having opposite axially forward and rearward ends, said elongate bit body having a central longitudinal axis about which the cutting bit is rotatable;

the bit body contains a pair of oppositely disposed discrete pockets in the axially forward end thereof, each one of the pockets having a rear surface and a bottom surface wherein at least a portion of the bottom surface presents an arcuate surface; and a pair of elongate cutting inserts, each one of the cutting inserts having opposite side surfaces wherein a layer of polycrystalline diamond covers substantially the entire area of one of the side surfaces, each one of the cutting inserts having a pair of edge surfaces wherein one of the edge surfaces is arcuate and the other of the edge surfaces having at least a portion thereof being arcuate, each one of the cutting inserts having an arcuate cutting edge defined at the intersection of the one side surface and the arcuate one edge surface, the arcuate cutting edge being defined by an included angle of between about 90 degrees and about 120 degrees, and each one of the cutting inserts being affixed in its corresponding pocket so that a portion of each one of the cutting inserts abuts the bottom surface of its corresponding pocket and so as to expose the cutting edge for cutting.

2. The cutting bit of claim 1 wherein the bit body is of a generally constant transverse dimension along the entire length thereof.

3. The cutting bit of claim 1 wherein the bit body includes a central bore therein, and the bore opening at the axially rearward end of the bit body.

4. The cutting bit of claim 3 wherein the bit body contains at least one fluid port in the axially forward end thereof, the fluid port being in communication with the central bore, and the fluid port being adjacent to the cutting inserts.

5. The cutting bit of claim 3 wherein the bit body contains a pair of diametrically opposed fluid ports in the axially forward end thereof, the fluid ports being in communication with the central bore, and each fluid port being adjacent to the cutting inserts.

6. The cutting bit of claim 1 wherein the one edge surface that is arcuate has a radius of curvature, each of the pockets presents an arcuate bottom surface that has substantially the same radius of curvature as that of the one edge surface that is arcuate.

7. The cutting bit of claim 1 wherein the exposed cutting edges of the cutting inserts extends across the diametrical transverse dimension of the bit body at the axially forward end thereof.

8. The cutting bit of claim 1 wherein the cutting inserts are diametrically spaced apart.

9. The cutting bit of claim 8 wherein the bit body contains a central bore opening at the axially rearward end of the bit body, the bit body contains a trio of diametrically aligned fluid ports in the axially forward end thereof, each of the fluid ports being in communication with the central bore.

10. The cutting bit of claim 8 wherein the exposed cutting edges of the cutting inserts extend from two diametrically opposed points radially outwardly across the diametrical transverse dimension of the bit body.

11. The cutting bit of claim 1 wherein the cutting inserts are affixed to the pockets by brazing.

12. The cutting bit of claim 11 wherein the braze alloy is a silver-based braze alloy.

13. The cutting bit of claim 12 wherein the braze alloy has a solidus of about 605° C. and a liquidus of about 620° C.

14. The cutting bit of claim 1 wherein the cutting insert comprises a substrate having a polycrystalline diamond layer thereon, and wherein the substrate is cobalt cemented tungsten carbide.

15. The cutting bit of claim 1 wherein each cutting insert has opposite side surfaces and opposite edge surfaces, one of the edge surfaces being arcuate in shape, and the one edge surface intersects a selected one of the side surfaces to define the arcuate cutting edge.

16. The cutting bit of claim 1 wherein the cutting insert comprises cobalt cemented tungsten carbide.

17. An elongate cutting insert for a cutting bit wherein the cutting bit has a pocket with a bottom surface, the insert comprising:

a pair of opposite front and rear surfaces, substantially the entire area of the front surface being covered by a layer of polycrystalline diamond material;

a pair of opposite edge surfaces, one of the edge surfaces being arcuate, the intersection of the front surface and the one edge surface defining an arcuate cutting, a portion of the other edge surface being of an arcuate shape, and a portion of the other edge surface abutting the bottom surface of the pocket; and the other edge surface has a central arcuate portion with a flat portion at each opposite end of the arcuate portion.

18. A cutting bit comprising:

an elongate bit body having opposite axially forward and rearward ends;

the bit body contains a pair of oppositely disposed pockets in the axially forward end thereof;

a pair of cutting inserts, each one of the cutting inserts having an arcuate cutting edge, the arcuate cutting edge being defined by an included angle of between 90 degrees and 120 degrees, and each one of the cutting inserts being affixed in its corresponding pocket so as to expose the cutting edge for cutting;

each cutting insert has opposite side surfaces and opposite edge surfaces, one of the edge surfaces being arcuate in shape and the one edge surface intersects a selected one of the side surfaces to define the arcuate cutting edge; and the other edge surface has a central arcuate portion with a flat portion at each opposite end of the arcuate portion.

19. The cutting bit of claim 18 wherein each one of the pockets has a bottom surface which corresponds in shape to the shape of the other edge surface.

20. A rotatable cutting bit comprising:

an elongate bit body having opposite axially forward and rearward ends, said elongate bit body having a central longitudinal axis about which the cutting bit is rotatable;

the bit body contains a pair of oppositely disposed separate pockets in the axially forward end thereof, each one of the pockets having a rear surface and a bottom surface wherein at least a portion of the bottom surface presents an arcuate surface; and a pair of elongate cutting inserts, each one of the cutting inserts having opposite side surfaces wherein a layer of polycrystalline diamond covers substantially the entire area of one of the side surfaces, each one of the cutting inserts having an arcuate cutting edge, the arcuate cutting edge being defined by an included angle of between about 90 degrees and about 120 degrees, and each one of the cutting inserts being affixed in its corresponding pocket so that a portion of each one of the cutting inserts abuts the bottom surface of its corresponding pocket and so as to expose the cutting edge for cutting, each of the cutting inserts has a pair of edge surfaces wherein at least one of the edge surfaces is arcuate in shape, and the arcuate cutting edge being defined at the intersection of the one side surface and an arcuate one of the edge surfaces, and a cutting insert has a pair of arcuate edge surfaces with each edge surface having substantially equal radii of curvature, and wherein each of the pockets presents an arcuate surface that has substantially the same radius of curvature as that of the arcuate edge surfaces.

21. An elongate cutting insert for a cutting bit wherein the cutting bit has a pocket with a bottom surface, the insert comprising:

a pair of opposite front and rear surfaces, substantially the entire area of the front surface being covered by a layer of polycrystalline diamond material;

a pair of opposite edge surfaces, one of the edge surfaces being arcuate, the intersection of the front surface and one edge surface defining an arcuate cutting edge, the other edge surface having a central arcuate portion with a flat portion at each opposite end of the arcuate portion, and a portion of the other edge surface abutting the bottom surface of the pocket.

* * * * *